US006109042A

United States Patent [19]

Woods et al.

[11] Patent Number: 6,109,042

[45] Date of Patent: Aug. 29, 2000

[54] SUPERCONDUCTING MAGNET BURST DISK VENTING MECHANISM

[75] Inventors: Daniel C. Woods; Lawrence V. Bischke; Jimmy LaBruce Turner; Phillip W. Eckels, all of Florence, S.C.

[73] Assignee: General Electric Company, Milwaukee, Wis.

[21] Appl. No.: 09/210,492

[22] Filed: Dec. 12, 1998

[51] Int. Cl.[7] ..... F25B 19/00

[52] U.S. Cl. ..... 62/51.1

[58] Field of Search ..... 62/51.1, 48.1

[56] References Cited

U.S. PATENT DOCUMENTS 4,516,404 5/1985 Laskaris ..... 62/51.1
4,522,034 6/1985 Laskaris ..... 52/51.1
4,535,596 8/1985 Laskaris ..... 62/51.1
5,291,739 3/1994 Woods et al. ..... 62/48.1
5,657,634 8/1997 Woods ..... 62/51.1

*Primary Examiner*—William Doerrler
*Attorney, Agent, or Firm*—Irving M. Freedman; Christian G. Cabou; Phyllis Y. Price

[57] ABSTRACT

A pressure relieving venting system for a liquid helium superconducting magnet to vent cryogen gas upon a magnet quench including a burst disk closing the venting system during normal superconducting operation and sandwiched between a peripheral gasket assembly maintained under constant pressure by a plurality of axially extending bolts, spring washers and nut assemblies to preclude helium gas leakage in the absence of the disk bursting under excessive pressure.

14 Claims, 2 Drawing Sheets

SUPERCONDUCTING MAGNET BURST DISK VENTING MECHANISM

BACKGROUND OF THE INVENTION

This invention relates to an assembly for cryogen gas venting for a superconducting magnet, particularly suitable for connecting the cryostat vent to the atmospheric vent for the superconducting magnet in the event of undesirable and dangerous high cryogen gas pressure buildup.

As is well known, a magnet can be made superconductive by placing it in an extremely cold environment, such as by enclosing it in a cryostat or pressure vessel containing liquid helium or other cryogen. The extreme cold reduces the resistance in the magnet coils to negligible levels, such that when a power source is initially connected to the coil to introduce a current flow through the coils, the current will continue to flow through the coils due to the negligible resistance even after power is removed, thereby maintaining a magnetic field. Superconducting magnets find wide application, for example, in the field of magnetic resonance imaging (hereinafter "MRI").

In the event of an undesired magnet quench or reversion to a non-superconductive state rapid potentially dangerous cryogen gas high pressure buildup in the cryostat requires pressure relief through rapid venting of the cryogen gas to the atmosphere outside the superconducting magnet. A replaceable burst disk assembly provided in the vent assembly ruptures at a predetermined pressure to open the vent to the atmosphere.

However, it has proven difficult as a practical matter to properly seal the vent assembly, yet provide for ready replacement of the burst disk and resealing of the vent assembly after a high pressure rupture.

One problem encountered is the inability of gaskets such as neoprene or silicone to withstand multiple extreme temperature cycles encountered as a result of periodically placing the MRI magnet into superconducting operation and the alternate cryogen refill and venting. Over time this has led to cracks in the gaskets and leakage of helium gas during operation. In addition, some materials have exhibited creep which also leads to helium gas leakage.

The problem of helium gas leakage is most significant in superconducting magnets which recondense the helium gas back to liquid helium and which are often referred to as zero boiloff (ZBO) magnets designed to minimize the difficulties encountered in shipping and storing the necessary reserve supply of liquid helium at cryogenic temperatures and the related problems of periodically transferring a portion of the liquid helium in the storage reservoir to the liquid helium supply in the MRI superconducting magnet.

A helium gas leak at the burst disk assembly will lead to the need to continuously add or replenish the liquid helium defeating the goal and advantages possible with a ZBO superconducting magnet.

SUMMARY OF INVENTION

Thus, there is the need for an improved burst disk assembly for a superconducting magnet which provides proper sealing yet can be readily replaced after rupture.

In accordance with one form of the invention, the pressure relieving venting system provided for a superconducting magnet includes a cryogen gas vent attached to the cryostat and connected to an atmospheric exhaust vent in order to vent a cryogen gas from the cryostat to the atmosphere outside the magnet in the event of an undesired pressure buildup. The venting system includes a burst disk interposed in and blocking the vent during normal operation of the superconducting magnet which is selected to burst in the event of a cryogen gas pressure which exceeds a predetermined amount. A deformable gasket contiguous to the disk seals the region between the burst disk and the vent and securing means including spring washers which extend substantially parallel to the vent and presses the burst gasket and the deformable gasket toward each other to seal the vent during normal superconducting operation.

More particularly, the gaskets may be peripherally joined to form a unitary subassembly of substantially U-shaped cross section and may include peripheral indentations to surround a portion of the bolts forming part of the securing means to assist in centering and securing the subassembly.

DESCRIPTION OF DRAWINGS AND INVENTION

Figure 1:
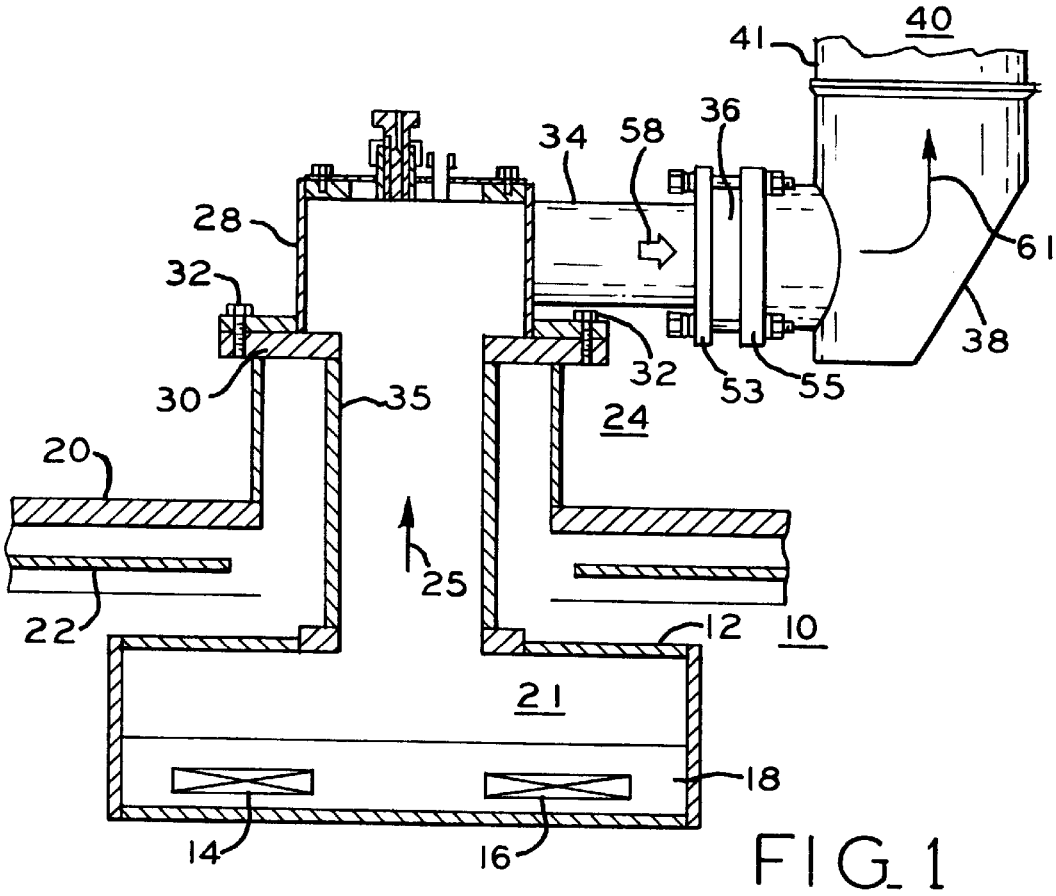
FIG. 1 is a simplified view of a superconducting magnet incorporating the invention.
Figure 2:
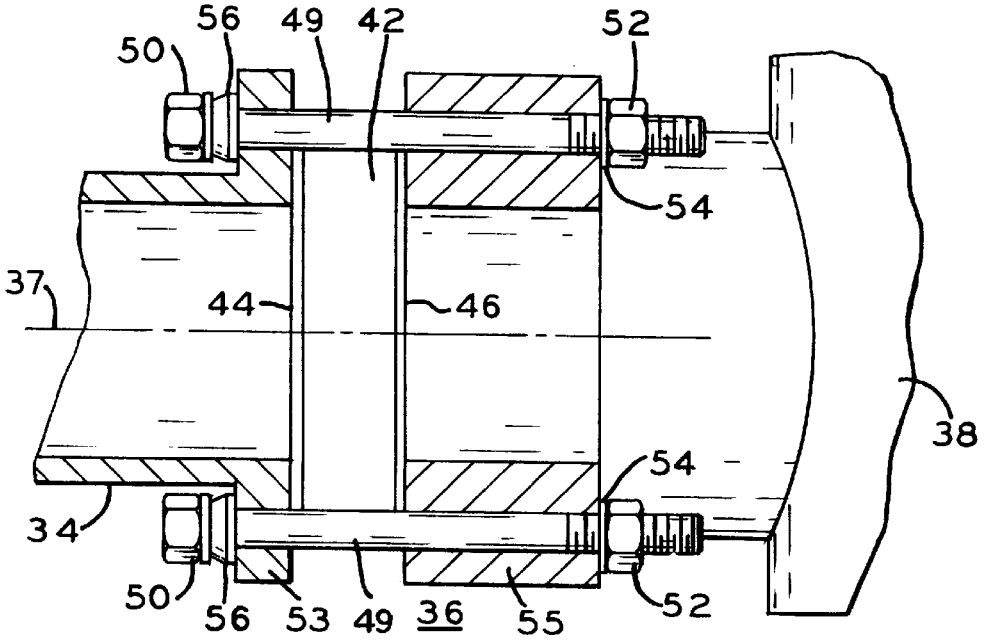
FIG. 2 is an enlarged view of a portion of FIG. 1 showing details of the invention.

Referring first to FIGS. 1 and 2, recondensing superconducting magnet system 10 includes cryostat or helium pressure vessel 12 (when liquid helium is the cryogen) which is shown schematically in a reduced size and which encloses a plurality of magnet coils such as 14 and 16 in liquid helium 18. Helium pressure vessel 12 is enclosed within a surrounding vacuum vessel 20 and intermediate members such as thermal radiation shield 22. Helium gas 21 forms above liquid helium 18 through the boiling of the liquid helium in providing cryogenic temperatures to superconducting magnet system 10 such that the extreme cold maintains current flow through the magnet coils after a power source initially connected to the coil (for a relatively short period) is disconnected due to the absence of electrical resistance of the cold magnet coils, thereby maintaining a strong magnetic field in the bore of the magnet. Helium gas which forms may be recondensed back to liquid helium by a mechanical refrigerator (not shown) or vented to the atmosphere through a small diameter vent (not shown). Superconducting magnet assembly 10 finds wide application in the field of MRI. Service turret 28 is bolted to collar 30 bv bolts 32. Collar 30 is connected to the interior of helium pressure vessel 12 by pipe 35 which provides external access for electrical leads (not shown) and for service purposes. Vent pipe 34 connects between service turret 28 and burst disk assembly 36 to exhaust vent assembly 38 which is connected to the outside atmosphere 40 through vent piping 41. Thus, burst disk assembly 36 provides a barrier between vent pipe 34 and vent assembly 38 during normal operation of superconducting magnet 10. Vent pipe 35 is of relatively large diameter such as 3 inches with vent piping 41 being of a larger diameter.

In case of an undesired quenching or discontinuance of superconducting operation of superconducting magnet assembly 10 as much as 1800 liters of liquid helium can be boiled off in a period as short as 20 seconds generating tremendous pressure and a large volume of helium gas which must be quickly vented to atmosphere 40 outside the building housing superconducting magnet system 10 in order to prevent damage to the superconducting magnet assembly. The rapid venting of helium gas to atmosphere 40 through vent piping 41 which typically is 6 inches in diameter is made possible by the bursting of burst disk 42 which is designed to rupture at a predetermined pressure above that produced during normal superconducting operation of magnet assembly 10. Burst disk 42 may be of graphite with a thickness of 1/10 inches which will, for example, burst at a pressure of approximately 20 pounds per square inch of helium gas pressure within service turret 28 allowing the helium gas buildup as indicated generally by arrows 25, 58 and 61 to rapidly vent to outside atmosphere 40 through the increasingly large passage provided by vent pipe 34 and vent assembly 38.

As best shown by FIG. 2, burst disk 42 is sandwiched between a pair of gaskets 44 and 46 of Teflon material such as that sold by Garlock as their Gylon 3540. Gaskets 44 and 46 provide proper and effective sealing off of vent assembly 38 when sandwiched assembly 42, 44, 46 is maintained under constant pressure by four circumferentially equally spaced bolts 49 which extend parallel to vent pipe 34 and its axis 37. Bolts 49 are secured at their remote ends by nuts 52. Interposed between bolt heads 50 of bolts 49 and flange or collar 53 of pipe 34 are Belleville spring washers 56 such as those sold by Key Belvilles as their model K0750-C-056-S washer Conically shaped spring washers 56 provide a constant pressure on the burst disk sandwich assembly consisting of burst disk 42 interposed between gaskets 44 and 46 which are pressed between collar 53 of pipe 34 and collar 55 of vent assembly 38. Nuts 52 are selectively tightened to provide a seating torque of 200 inch pounds on the sandwich assembly 44, 42, 46 to ensure proper sealing of burst disk 42 during normal superconducting operation of magnet system 10.

It was found that gaskets or washers 44 and 46 were superior to conventional neoprene or silicon gaskets which have been found to fail over time, particularly when exposed to multiple cryogenic temperature cycles each time superconducting magnet assembly 10 is placed into superconducting operation or when superconducting operation ceases or during liquid helium refilling of the magnet assembly. Such gaskets have become hard and have exhibited cracks which cause leaks of helium gas instead of providing a gas tight seal which is required in the absence of a rupture of burst disk 42. However, it was found that gaskets 44 and 46 while not subject to degradation due to cryogenic thermal cycling exhibited creap or slight movement over time and temperature cycling which could also result in liquid gas leaks. However, it was found that the combination of the use of Gylon 3540 Teflon material as the washers in combination with Belleville washers 56 did not exhibit leaking over multiple exposures of temperature due to cryogenic cycling of superconducting magnet assembly 10.

Figure 3:
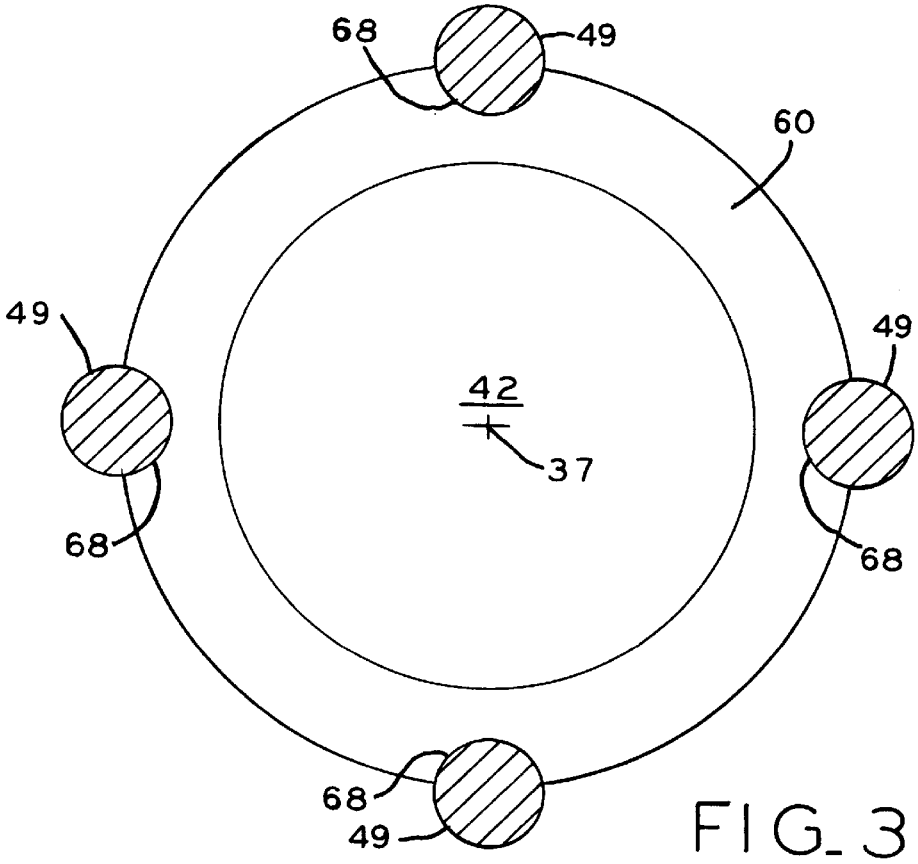
FIG. 3 is an enlarged view of a unitary gasket variation of FIG. 2 showing gasket entering means.
Figure 4:
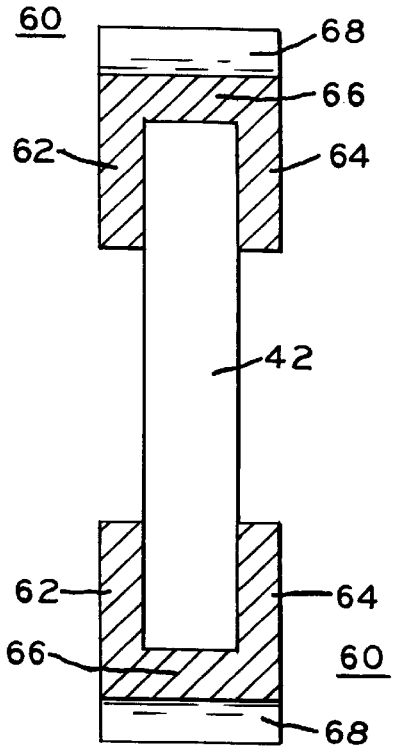
FIG. 4 is an enlarged cross-sectional side view of the gasket portion of FIG. 3.

In order to facilitate assembly burst disk gaskets 44 and 46 are cemented, at least along their peripheries to burst disk 42 to provide a unitary subassembly is shown in FIGS. 3 and 4.

Referring next to FIGS. 3 and 4, unitary gasket 60 includes a generally U-shaped cross section (best shown in FIG. 4) including legs 62 and 64 with connecting portion 66, and which surrounds the peripheral or circumferential region of burst disk 42. The generally donut configuration of unitary flexible gasket 60 enables it to be snapped around the peripheral edges of burst disk 42, such that the gasket and burst disk become a unitary subassembly as shown in FIG. 4. Surrounding the outer edge 66 of burst disk 42 with unitary gasket 60 avoids possible gas helium leakage which could occur if the cementing of gaskets 44, 46 to the burst disk (see FIG. 2) is not completely gas-tight around their entire periphery.

Semi-circular indentations 68 are positioned to partially surround bolts 49 (see FIG. 3) to aid in the centering or positioning and retention of gasket-burst disk subassembly 60, 42 in the position shown in FIGS. 1 and 2.

While the present invention has been described with respect to certain preferred embodiments thereof, it is to be understood that numerous variations in the details of construction, the arrangement and combination of parts, and the types of materials used may be made without departing from the spirit and scope of the invention.

What is claimed is:

1. A cryostat pressure relieving venting system for a superconducting magnet including a cryogen gas vent attached to the cryostat and connected to an exhaust vent in the enclosure in which the superconducting magnet is installed in order to vent cryogen gas from the cryostat to the atmosphere outside the magnet in the event of an undesired pressure buildup including a burst disk assembly comprising:

a burst disk interposed in and blocking said vent during normal operation of said superconducting magnet;

said burst disk selected to burst in the event of a cryogen gas pressure in said cryostat which exceeds a predetermined pressure in order to open a path between said cryostat to said atmosphere;

a deformable circular gasket forming a ring with a substantially U-shaped cross section surrounding the peripheral edges of said burst disk to cover said peripheral edges and adjacent regions of said burst disk on the opposite sides thereof and form a unitary subassembly to seal said peripheral edges in the region between said burst disk and said vent; and securing means for said burst disk assembly extending substantially parallel to the axis of said vent to apply constant pressure to said subassembly to press said burst disk and deformable gasket toward each other to provide said seal;

said unitary subassembly facilitating replacement thereof in the event of a burst disk.

2. A cryostat pressure relieving venting system for a superconducting magnet including a cryogen gas vent attached to the cryostat and connected to an exhaust vent in the enclosure in which the superconducting magnet is installed in order to vent cryogen gas from the cryostat to the atmosphere outside the magnet in the event of an undesired pressure buildup including a burst disk assembly comprising:

a burst disk interposed in and blocking said vent during normal operation of said superconducting magnet;

said burst disk selected to burst in the event of a cryogen gas pressure in said cryostat which exceeds a predetermined pressure in order to open a path between said cryostat to said atmosphere;

a deformable circular gasket forming a ring with a substantially U-shaped cross section surrounding the peripheral edges of said burst disk to form a subassembly to seal the region between said burst disk and said vent;

securing means for said burst disk assembly extending substantially parallel to the axis of said vent to press said burst disk and deformable gasket toward each other to provide said seal;

a pair of members positioned on opposite sides of said gasket; and adjustment means to move one of said members toward the other of said members to compress said gasket therebetween.

3. The cryostat pressure relieving venting system of claim 2 wherein said adjustment means includes a plurality of bolt and nut assemblies with spring washers to maintain pressure on said gasket.

4. The cryostat pressure relieving venting system of claim 3 wherein said gasket includes peripheral indentations which surround at least a portion of said bolts to position said subassembly within the region between said bolts.

5. The cryostat pressure relieving venting system of claim 4 wherein said gasket is a Teflon material.

6. The cryostat pressure relieving venting system of claim 5 wherein rotation of said nuts applies selective pressure on said gasket by said pair of members.

7. A cryostat pressure relieving venting system for a superconducting magnet including a cryogen gas vent attached to the cryostat and connected to an exhaust vent in the enclosure in which the superconducting magnet is installed in order to vent cryogen gas from the cryostat to the atmosphere outside the magnet in the event of an undesired pressure buildup comprising:

a burst disk interposed in and blocking said vent during normal operation of said superconducting magnet;

said burst disk selected to burst in the event of a cryogen gas pressure in said cryostat which exceeds a predetermined pressure in order to open a path between said cryostat to said atmosphere;

a pair of contiguous deformable gaskets sandwiching said burst disk to seal the region between said burst disk and said vent; and gasket securing means for said burst extending substantially parallel to the axis of said vent to press said burst disk and deformable gasket toward each other to provide said seal;

said securing means including spring washers providing constant pressure on said burst disk and gasket.

8. The cryostat pressure relieving venting system of claim 7 wherein said deformable gasket is a Teflon material.

9. The cryostat pressure relieving venting system of claim 7 wherein said securing means includes a pair of opposed collars and a plurality of adjustable bolt assemblies to move said collars toward each other and toward said deformable gasket positioned between said collars.

10. The cryostat pressure relieving venting system of claim 9 wherein said securing means include rotatable nuts to adjust said constant pressure.

11. The cryostat pressure relieving venting system of claim 10 wherein said spring washers are conical washers.

12. The cryostat pressure relieving venting system of claim 11 wherein one of said collars is on an assembly open to the atmosphere surrounding said superconducting magnet and the other collar is on a pipe connected to a passageway leading to the interior of said cryostat.

13. The cryostat pressure relieving system of claim 9 including a gasket connecting portion between the peripheries of said deformable gasket to surround the periphery of said burst disk with a unitary gasket.

14. The cryostat pressure relieving venting system of claim 13 wherein there is at least four circumferentially substantially equally spaced securing means.

* * * * *